US006356195B1

(12) United States Patent
Olsen et al.

(10) Patent No.: US 6,356,195 B1
(45) Date of Patent: Mar. 12, 2002

(54) ANTI-PILFERAGE SYSTEM

(75) Inventors: Fred Olsen, Oslo (NO); Frank Sherer, Middlebury, CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/595,277

(22) Filed: Jun. 15, 2000

(51) Int. Cl.[7] ..... G08B 13/14

(52) U.S. Cl. ..... 340/568.1; 340/568.8; 340/571; 340/572.3; 340/539

(58) Field of Search ..... 340/568.1, 568.8, 340/571, 572.3, 539

(56) References Cited

U.S. PATENT DOCUMENTS

| | | | | | |
|---|---|---|---|---|---|
| 4,021,705 | A | * | 5/1977 | Tichtblau | 361/402 |
| 4,652,732 | A | | 3/1987 | Nicki | 235/462 |
| 5,026,975 | A | | 6/1991 | Guber et al. | 235/463 |
| 5,105,190 | A | * | 4/1992 | Kip et al. | 340/825.54 |
| 5,311,969 | A | | 5/1994 | Dickover et al. | 186/61 |
| 5,406,261 | A | * | 4/1995 | Glenn | 340/571 |
| 5,488,571 | A | | 1/1996 | Jacobs et al. | 364/705.07 |
| 5,555,226 | A | | 9/1996 | Lizzi | 368/21 |
| 5,767,771 | A | * | 6/1998 | Lamont | 340/571 |
| 5,964,877 | A | * | 10/1999 | Victor et al. | 713/202 |
| 6,104,281 | A | * | 8/2000 | Heinrich et al. | 340/10.5 |

* cited by examiner

*Primary Examiner*—Daniel J. Wu
*Assistant Examiner*—Tai T. Nguyen
(74) *Attorney, Agent, or Firm*—Carmody & Torrance LLP

(57) ABSTRACT

A system for discouraging the unauthorized removal of an electronic device from a designated area is provided. The electronic device includes at least one functional feature (such as a display, speaker, power enabler, controller, etc.) for performing at least one desired function and an enabler, operatively coupled to the functional feature, for enabling the functional feature to perform the at least one desired function. The system further includes a security device that generates a signal, such as an electromagnetic field, so as to cause the enabler to enable the functional feature to perform the at least one desired function. The enabler may comprise a breakable link, such as a fuse. When the electronic device is placed in proximity to the electromagnetic field, the link is broken and the functional feature is enabled. In another preferred embodiment, the electronic device may include a controller operatively coupled to the functional feature for controlling the operability of the functional feature. In this alternate embodiment, the enabler is operatively coupled to the controller, and enables the controller to control the operability of the functional feature. A method for discouraging the unauthorized removal of the electronic device from a designated area is also provided.

40 Claims, 2 Drawing Sheets

ANTI-PILFERAGE SYSTEM

BACKGROUND OF THE INVENTION

The present invention relates generally to anti-pilferage systems, and in particular, to an improved anti-pilferage system for preventing, discouraging and deterring the theft of electronic products from a designated area, such as a store or other area where the electronic products may be kept.

There are numerous existing anti-pilferage systems. One very common system includes the use of a designated "tag" that is affixed to the electronic product or other consumer article. The "tag" preferably includes a tuned resonant circuit. A receiver and separate coils that radiate a particular frequency are located at the exit of the store, and create the necessary magnetic/electric field to detect the "tag" as it enters the field. If someone attempts to improperly remove the consumer article from the store with the "tag" still activated, an alarm will sound. The "tag" is typically deactivated by having the "tag" exposed to a high-radiated field to fuse open a link in the "tag". Once the link in the "tag" is opened, the coils at the exit of the store will no longer detect the "tag".

Other systems to thwart pilferage are also known. Another known example merely places a similar "tag" as that described above on or in connection with the consumer article or electronic product. Such a "tag" is removed by the person at the checkout counter after the purchase has been made. Such "tags", as implied above, may be used for the prevention of clothing as well.

The state of the art anti-pilferage systems are unfortunately less than desirable. For example, if either of the foregoing "tags" is removed from the article while in the store, the article, whether it is clothing or otherwise, can be simply removed from the store with impunity. Still further, many of the "gates" at the exit of the store to detect the existence of such "tags" are low to the ground, or small enough to permit a determined (or tall) individual to avoid having the article enter the field created by the exit gate. Still further, the "tags" could merely be removed from the article by an unscrupulous checkout counter person prior to and/or in lieu of sale of the article. This would require the checkout person to aid the theft, but nonetheless could be done without the employer or other person in authority being able to determine who actually removed the "tag". Lastly, the above-identified systems do not in any way address the concern of theft by the employees themselves.

Accordingly it is desirable to provide an anti-pilferage system that overcomes the aforementioned drawbacks and achieves the aforementioned and below mentioned objectives. In particular, it is desirable to provide a system for discouraging the unauthorized removal of an electronic device from a designated area, and the present invention, as disclosed herein, achieves such objectives.

SUMMARY OF THE INVENTION

Generally speaking, in accordance with the present invention, a system for discouraging the unauthorized removal of an electronic device from a designated area is provided. In a preferred embodiment, the electronic device may include at least one functional feature (such as a display, speaker, power enabler, controller, etc.) for performing at least one desired function, an enabler operatively coupled to the functional feature for first disabling the functional feature from performing the at least one desired function and also for thereafter enabling the functional feature to perform the at least one desired function, and a security device comprising a generator for generating a signal (which may be in the form of the generation of an electromagnetic field) to the device so as to cause the enabler to enable the functional feature to perform the at least one desired function.

In one embodiment, the enabler may comprise a breakable link, such as a fuse operatively coupled to the functional feature, for initially disabling the functional feature from functioning when the fuse is not broken. When the security device generates the signal, and in this case most preferably the signal is in reality the generation of an electromagnetic field, it causes the breaking of the link, and the functional feature is thereby enabled. That is when the electronic device is placed in proximity to the electromagnetic field, the link is broken and the functional feature is enabled. In the preferred embodiment, the security device need not be in physical or electrical contact with the electronic device.

In another preferred embodiment, the electronic device may include a controller operatively coupled to the functional feature for controlling the operability of the functional feature. In this embodiment, the enabler is operatively coupled to the controller and initially disables the controller from controlling the functional feature and thereafter, as disclosed below, enables the controller to control the operability of the functional feature. Here, for example, the controller may also itself be operable in a plurality of modes, and the enabler may operatively prevent the controller from operating in at least one of the plurality of modes. For example, as long as the enabler prevents the controller from being fully operational, the device may remain in a demonstration mode only. For example, the controller may be programmed to enter both a demonstration mode and an operational mode. However, with the enabler disabling the controller, such as if the enabler is a link that is unbroken as disclosed below, the electronic device may be constructed in such a way that it cannot (a) exit the demonstration mode nor (b) enter the operational mode until the security device generates the signal to the enabler thereby enabling the controller.

In still another embodiment, the enabler may be a smart receiver for receiving the signal from the transmitter of the security device. The smart receiver may include a transmitter for transmitting information to the security device.

In yet another embodiment, the system may include a scanner for transmitting a signal, such as an optical signal containing coded information, and an electronic device, which itself may include a receiver for receiving the signal from the scanner and for processing the coded information contained therein, at least one functional feature for performing at least one desired function, and controller operatively coupled to the receiver and the at least one functional feature, for operatively enabling the functional feature to perform the at least one desired function upon the receipt and decoding of the coded information (by the receiver) in the signal transmitted by the scanner. The controller may control the performance and enablement of the at least one functional feature, and is disabled until the receiver receives and processes the coded information. A method of discouraging the unauthorized removal of such a device is also provided.

In yet another embodiment of the invention, a method of discouraging the unauthorized removal of an electronic device from a designated area is provided. The electronic device comprises the features set forth above, and the method preferably comprises the steps of providing a security device, generating a signal radiating outward from the security device to the electronic device, and causing the enabler to enable the functional feature, and thus causing the functional feature to perform the at least one desired function. In one preferred method, the enabler comprises a breakable link operatively coupled to the functional feature, and the method comprises the further steps of generating a electromagnetic field, placing the electronic device in proximity to the electromagnetic field, causing the breaking of the link and enabling the functional feature.

In yet another methodology, the electronic device may further comprise a controller operatively coupled to the functional feature for controlling the operability of the functional feature and an enabler operatively coupled to the controller, wherein the method comprises the steps of providing a security device, generating a signal radiating outward from the security device to the electronic device, and causing the enabler to enable the controller and thus causing the controller to control the operability of the functional feature.

In still further embodiments of the present invention an enabler for use in an electronic device that is part of a system for discouraging the unauthorized removal of the electronic device from a designated area is provided. In particular, the preferred enabler prevents a functional feature from performing a desired function and enables the functional features to perform the at least one desired function, wherein the enabler initially disables the functional feature and thereafter enables the functional feature to perform the at least one desired function upon the sufficient entering of an electromagnetic field generated by a security device. In one embodiment, the enabler may comprise a breakable link. In yet another embodiment, the electronic device may comprise a controller operatively coupled to the functional feature for controlling the operability of the functional feature; and the enabler, being operatively coupled to the controller, prevents the operability of the functional feature by disabling and thereafter enabling the controller to control the operability of the functional feature.

In yet still further embodiments, a security device for use in such a system is provided, and further in yet another embodiment, various configurations of the electronic device itself is provided.

Accordingly, it is an object of the present invention to provide an anti-pilferage system for discouraging the unauthorized removal of an electronic device from a designated area.

Yet another object of the present invention is to provide an improved anti-pilferage system that provides for accountability for the enabling of the electronic device.

Still another object of the present invention is to provide an improved anti-pilferage system that permits for identification of the person that enables the electronic device, thereby helping to discourage theft thereof.

Another object of the present invention is to provide an improved anti-pilferage system that discourages the theft of an electronic device by prohibiting a desired operation of the electronic device unless and until the electronic device is enabled by an authorized person.

And yet another object of the present invention is to provide discouragement for in-store employees from assisting in the pilfering of the consumer article.

And still another object of the present invention is to provide an improved anti-pilferage system that provides for improved inventory controls.

Lastly, it should be recognized that the reference to electronic devices should be interpreted in its broadest sense and be understood to include, but not be limited to timepieces such as watches, PDA's, telephones, video games, computer equipment, and any other electronic device. Such devices may be purchased from a store or stored in a warehouse, the important aspect being understood that the electronic device is constructed to operate in at least one less effective manner unless and until it is appropriate or necessary (i.e. the electronic device is purchased through legitimate channels, for example) to enable or otherwise "activate" the device to operate in the more effective manner (i.e. the device itself operates, or a particular feature, such as the display or speaker, operates).

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

DETAILED DESCRIPTION OF THE PREFERRED EMBODIMENTS

Generally speaking, the present invention recognizes the need to make a portion of the anti-pilferage system an integral part of the electronic device. Preferably, and as discussed in greater detail below, the anti-pilferage system effectively changes, alters or otherwise inhibits the performance characteristics of the electronic device, until such time as it is desired to "deactivate" that which changed, altered or otherwise inhibited the particular performance characteristic. That is, until such time as it is appropriate (i.e. the electronic device is purchased) to enable or "activate" all the features of the electronic device, the electronic device remains less than 100% operational. Such "activation" could be performed by an authorized store clerk or other check-out personnel. Importantly, without the "activation" taking place; the electronic device may remain substantially useless or be severely limited in its performance or function.

Figure 1:
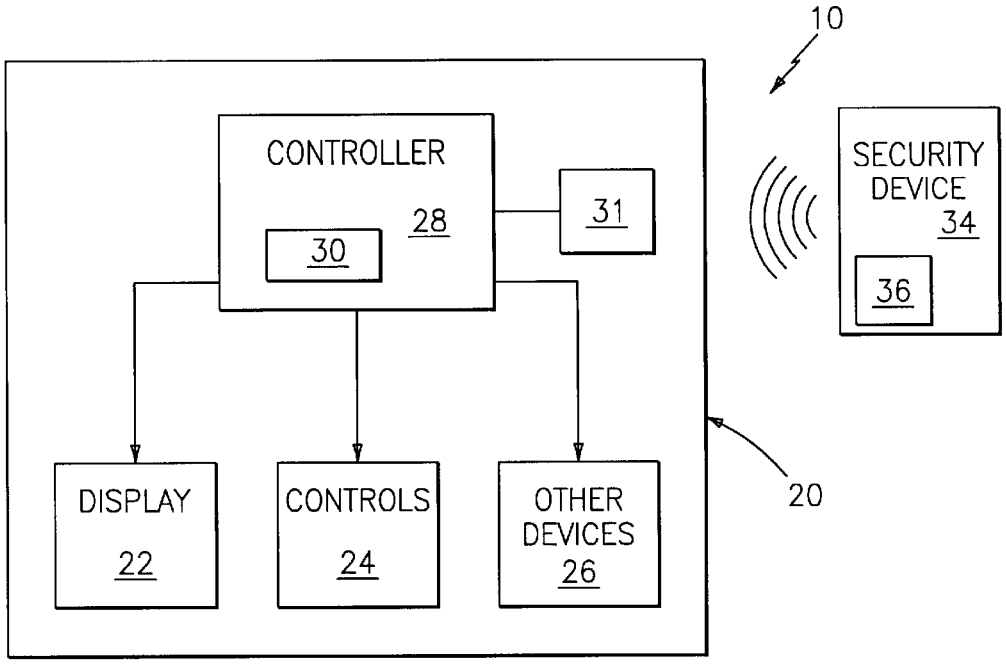
FIG. 1 is block diagram of an anti-pilferage system constructed in accordance with a first embodiment of the present invention.

Reference is now made to FIG. 1 which illustrates an anti-pilferage system, generally indicated at 10, constructed in accordance with a first embodiment of the present invention. Generally speaking, system 10 is constructed for discouraging the unauthorized removal of an electronic device, generally indicated at 20, from a designated area, such as a store or warehouse (not shown). As stated above, electronic device 20 may be any number of devices, such as a watch, PDA, pager, a piece of video or computer equipment such as a camera or monitor or printer, a clock or other timekeeping device, or any other number of devices for the home, office or recreation, the important aspect being that the device includes circuitry or software or other features that can be enabled or disabled, preferably from an external security device, as discussed below. Accordingly, by way of example and not limitation, it will be assumed that electronic device 20 is a watch, such as that disclosed in U.S. Pat. No. 5,555,226, the disclosure of which is incorporated by reference as if fully set forth herein.

As illustrated in FIG. 1, electronic device 20 preferably includes at least one functional feature and, most likely, will include more. Examples of such features are a display 22, controls 24, such as those features for receiving information from a computer as described in U.S. Pat. No. 5,488,571, the disclosure of which is also incorporated by reference as if fully set forth herein, or any other feature or device, such as a speaker 26 or alarm. The feature itself may be the power supply, thus preventing the electronic device from operating at all until the enabler enables the functional feature or controller as disclosed below. Device 20 preferably also includes a controller, either comprised of hardware, software or a combination of both, generally indicated at 28, operatively coupled to functional features 22, 24 and/or 26. In particular, controller 28 may include a subcontroller 30, comprised of hardware, software or both, as would be understood in the art, for causing electronic device 20 to perform the at least one desired function, such as to display indicia on display 22, or sound an alarm on speaker 26 or be able to enter an operational mode from a demonstration mode, which may be controlled by controls 24, or by controller 28 itself. Additionally, controller 28 may be able to enter a plurality of modes as further disclosed herein. That is, controller 28 may control a number of functions, such as those described in U.S. Pat. No. 5,488,571.

Controller 28 preferably also includes an enabler 31, operatively coupled to controller 28, for enabling controller 28 and/or subcontroller 30 to permit performance of the at least one desired function.

Figure 3:
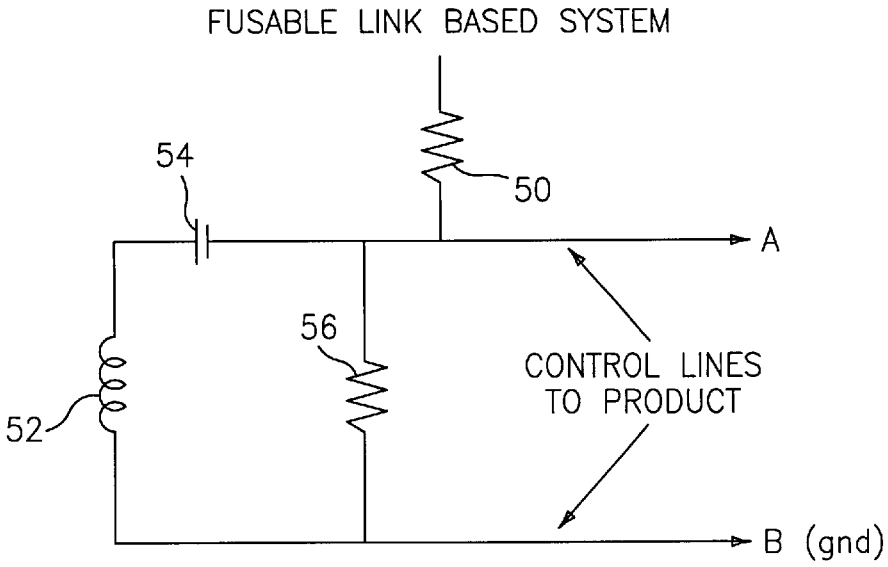
FIG. 3 is simplified circuit diagram illustrating a fuse or other link type construction for incorporation into an electronic device to be used in the anti-pilferage system constructed in accordance with the present invention.

Reference is now made to FIG. 3 in connection with the following disclosure for an understanding of a preferred construction of enabler 31. In particular, a fusable link implementation is provided. If implemented in a microprocessor-based device, such as device 20, utilizing the disclosed construction provides for the temporary "shorting" of controller 28 and/or subcontroller 30. Alternatively, enabler 31 may be coupled to controller 28 in a manner so as to cause controller 28 to read a predetermined logic level (i.e. "logic low") on a selected data line. In a non-microprocessor-based product that does not include a controller 28, the enabler illustrated in FIG. 3 can be placed directly across the feature, such as the display, speaker or power supply, rendering such features or the display itself temporarily inoperable.

As illustrated in FIG. 3, control lines "A" and "B" are operatively coupled across one of the functional features (i.e. a display, a control or a speaker) in a non-microprocessor-based product, and, in a microprocessor-based device, such control lines are coupled across or to controller 28 in such a manner to render controller 28 inoperable, or coupled to controller 28 in such a manner that controller 28 operates in a limited manner until the aforementioned logic level being read thereby is changed (i.e. "logic low" to logic high"). The inventors also recognize that control lines "A" and "B" could also be operatively coupled across one of the functional features (i.e. display 22, controls 24 or speaker 26) in the microprocessor-based product as well, and this option should be appreciated as well. In this way, controller 28 can remain in full operation and provide for the monitoring of the status of such features (i.e. a logic low on a status line, etc.) when such features 22, 24 or 26 are being shorted by enabler 31.

The preferred enabler 31 comprises a pull-up resistor 50 in series with a combination inductor 52 and a capacitor 54. A link, such as a fuse 56, is coupled across control lines "A" and "B" which themselves are coupled to controller 28 or the functional feature(s) as disclosed above. In this way, with fuse 56 in place, controller 28 and/or the functional feature (s) may be inoperative (i.e. shorted) until the fuse is "opened" or broken.

In this embodiment therefore, a security device, such as that disclosed below, is provided. Such a security device preferably is designed to generate a signal and in this application, the generation of a signal is intended to include the generation of a relatively high enough electromagnetic field to induce a sufficiently high enough current to "fuse open" the fusable link 56. For this reason, security device preferably includes an electromagnetic field generator as would be readily known by one skilled in the art. In this way, controller 28 or the functional feature(s) as the case may be, would no longer be shorted and the full operation of the electronic device 20 would be achieved. This action would preferably occur when electronic device 20 is placed in proximity to the electromagnetic field created by security device 34. It should be understood that security device 34 need not be physically or electrically connected to device 20 in order to "fuse open" fusable link 56. That is, the necessary current can be induced without any direct physical or electrical contact between security device 34 and device 20. Mere sufficient proximity between security device 34 and device 20 is all that is necessary. As should be appreciated, the fusable link feature can be used in a broader capacity, for example, to render a particular signal or render a mode in the device inoperable. For example, the fusable link embodiment can be utilized to cause electronic device 20 to remain in a demonstration mode until the electronic device is placed in the proximity to the electromagnetic field, as set forth above. Such would need to incorporate the operation of controller 28 or controls 24. Likewise, electronic device 20 may have only selected features disabled, as set forth above.

As indicated above, to complete the anti-pilferage system 10 of this first embodiment, security device 34 comprises at least a generator 36 for generating the signal to "fuse open" fuse 56. For clarity, it should be understood for purposes of the present application, the term "signal" should be understood in its broadest sense, in that references to the security device generating a signal to the electronic device are intended to cover the generation of both an electromagnetic field as disclosed herein or a more conventionally understood signal. In this way, enabler 31 will operatively cause the performance of the at least one desired function, or enable the device to operate fully, from its initially completely or substantially disabled or limited mode as disclosed above. That is, with fuse 56 open, controller 28 and/or controls 24 or other features 22 or 26, as the case may be, will function.

In the microprocessor-based device, subcontroller 30 and/or controller 28 can cause device 20 to operate in a number of ways. For example, electronic device 20 upon initial manufacture may only be able to operate in a demonstration mode until such time as controller 28 receives the enabling signal (i.e. "fuse open" of fuse 56) caused by the transmitted signal (i.e. transmission of the necessary electromagnetic field) from security device 34. Upon receipt of the appropriate information by controller 28, device 20 can enter the operational mode where all functions of the device are enabled. In one example, electronic device 20 may not be able to (a) exit a demonstration mode nor (b) enter the operational mode until the enabling signal (i.e. the electromagnetic field created by generator 36) is received.

Similarly, device 20 may be constructed such that upon manufacture, individual features such as display 22, controls 24 or other devices 26, are initially disabled. For example, electronic device 20 will not display indicia on display 22 nor output sound through speaker 26 until the fuse 56 is "opened". In this case, the power supply may be disabled, for example.

In an embodiment where a microprocessor, such as controller 28, is provided in electronic device 20, security device 34 may also include a receiver, or a transceiver for both receiving and transmitting information from and to electronic device 20. In this manner likewise, the device 20 would also have the corresponding receiver and transmitter for bi-directional communication with security device 34. In this way, a more sophisticated exchange of information between security device 34 and electronic device 20 is achievable. For example, each electronic device 20 may include a unique identifier that can be downloaded to, and can be stored in a central system (not shown), thereby providing information about which particular electronic devices have been sold or "activated" in accordance with the present invention and which particular security device 34 did the "activation".

Figure 2:
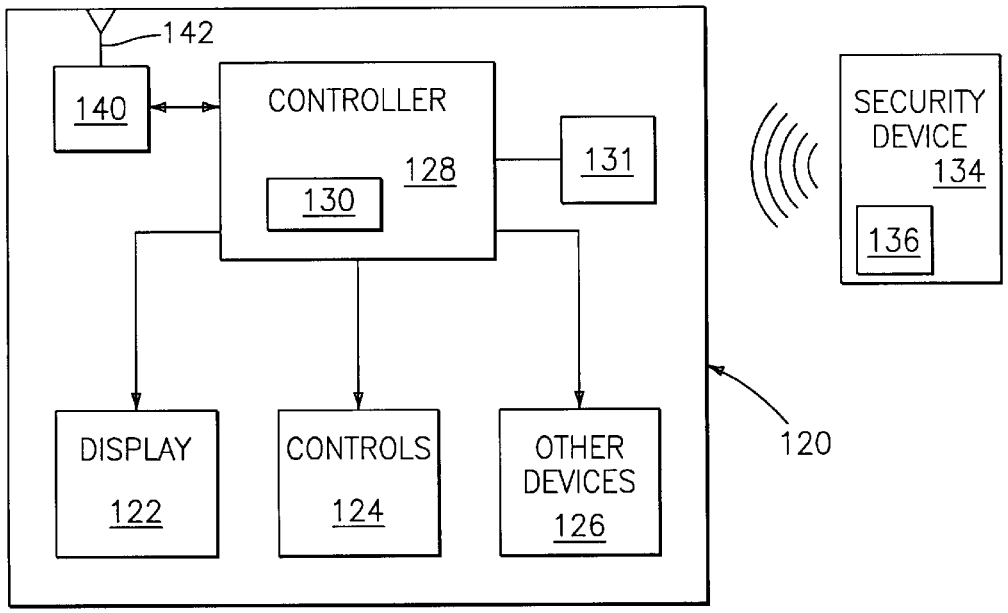
FIG. 2 is a block diagram of an alternate embodiment of an anti-pilferage system constructed in accordance with the present invention.

Consistent therewith, reference is now made to FIG. 2 to highlight the preferred construction to carry out the aforementioned additional aspect that may be incorporated into the present invention. Generally speaking, the present invention may take advantage of the opportunities afforded by what is known in the art as "smart technology". In this alternative embodiment, it should be understood that features 22, 24 and/or 26, controller 28, subcontroller 30, enabler 31 and security device 34 correspond to and are at least equal in functionality, configuration and construction as corresponding features 122, 124 and/or 126, controller 128, subcontroller 130, enabler 131 and security device 134.

In particular, a smart device such as smart receiver 140, and an antenna 142 coupled thereto, can be embedded directly into electronic device 120. Such technology is readily available from such companies as Gemplus and Motorola. Smart receiver 140 would also contain its own transceiver (not shown) for communicating in a bi-directional manner with security device 134. It should likewise be understood that security device 34 need not be physically or electrically connected to device 120 or smart receiver 140, the only requirement is the necessary proximity to establish the necessary connection. In this manner, electronic device 120 may be enabled in a manner discussed above (i.e. utilizing enabler 131) and also receive information based on information transmitted via smart receiver 140. Preferably, smart receiver 140 picks up enough of the radiated field to provide power to its embedded microprocessor, transmitter and receiver. It is also envisioned that the enabler 131, in this alternative embodiment, may be eliminated in the event that the signal to "activate" controller 128 is a signal received by directly by smart receiver 140 and transmitted to controller 128. That is, the enabler may be the smart receiver itself.

Figure 4:
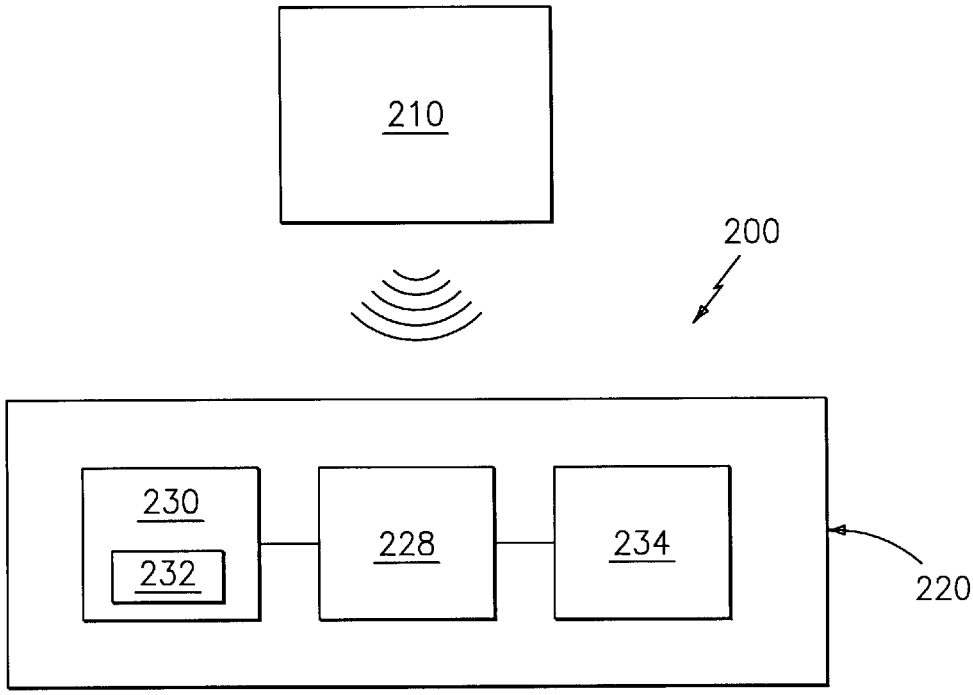
FIG. 4 is block diagram of an anti-pilferage system constructed in accordance with a yet another embodiment of the present invention.

Reference is now made to FIG. 4 which illustrates an anti-pilferage system, generally indicated at 200, constructed in accordance with yet another alternative embodiment of the present invention. System 200 may incorporate and work in combination with existing technology, such as that described in U.S. Pat. Nos. 5,026,975 or 5,311,969, 4,652,732 the disclosures of which are all incorporated be reference as if fully set forth herein.

System 200 is preferably comprised of an optical scanner 210, which may be located at the cashier stand in the store (not shown), and may be configured to read UPC codes on a product in a manner well understood in the art.

In accordance with the present invention, scanner 210 may (optionally) first read the UPC code on the electronic device, generally indicated at 220. If the device being read is one in which it is determined that the enabler should be activated, scanner is preferably designed and configured to include operative functionality to further transmit a predetermined signal, for example, in a particular light sequence, although a light sequence is by example and not limitation, to the device 220. If device 220 is a microprocessor-based device, it would preferably include a controller 228, similar to controller 28, and would further include a receiver 230 with a processor, such as an optical processor 232 (as would be known in the art), for receiving, processing and decoding the light sequence (digital signal) transmitted by scanner 210. In this way, if scanner 210 transmits the proper signal and is received by device 220, controller 228 would be "activated" in a manner consistent with that disclosed above. That is, device 220 would not become fully operational, for example, unless and until device 220 received the authorized signal from scanner 210. Such a signal being transmitted could depend on the proper reading of the UPC codes by scanner 210. The communication between the receiver and the controller would be well understood by one skilled in the art. In such a situation, functional features 234, which could include all or some, and thereby correspond to features 22, 24 and 26, would then be operational. It should be understood that the signal may be an RF signal, and such a signal may be the signal generated by the security device in each embodiment disclosed herein, thereby appreciating the broad configurations and applicability of the present invention.

Likewise, device 220 may be a non-microprocessor-based device. In this case, device may include a monitor or other circuitry that would likewise receive and decode the transmitted signal from scanner 210. In this way, if the proper signal is transmitted by scanner 210 and received by device 220, a logic signal could be generated and cause, by way of example and not limitation, a relay to switch from a first position to a second position thereby causing the functional features, such as the corresponding features 234 that correspond to features 22, 24 and 26 of device 20 to become operational. Similarly, the relay or controller 228 could cause the respective device to operate only in a demonstration mode unless or until the device was properly "activated" by the scanner 210. It should also be understood that all the features, structure and advantages recognized and disclosed with regard to the embodiments of FIGS. 1 and 2 are likewise achievable with regard to system 200. Accordingly, it is of the utmost importance to recognize that the generation and transmission of signals in this alternative embodiment (FIG. 4) can be implemented in those embodiments disclosed above while remaining within the scope of the invention. Hence the "signal generator" must be understood to include both emf, optical and/or electrical signals. It is also well understood that bi-directional communication is achievable, thereby being able to appreciate the aforementioned and below-mentioned objectives. It should be understood that in the above-described example, the signal may be an optical signal. However, it is also within the scope of the skilled artisan that the signal may be electrical, RF or otherwise so as to cause the enablement of the electronic device 220 in the manner disclosed herein.

It can therefore be seen that an anti-pilferage system constructed in accordance with the present invention will discourage the unauthorized removal of an electronic device from a designated area, such as a store or warehouse. Such an anti-pilferage system provides for accountability for the enabling of the electronic device (i.e. permits for identification of the person that enables the electronic device, thereby helping to discourage theft thereof), as the security device can be identified as the responsibility of a particular person at any time. Moreover, such an anti-pilferage system discourages the theft of an electronic device by prohibiting a desired operation of the electronic device unless and until the electronic device is enabled by an authorized person. Such an anti-pilferage system also discourages in-store employees from assisting in the pilfering of the consumer article while also improving inventory controls therefor.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein and all statements of the scope of the invention which as a matter of language might fall therebetween.

What we claim is:

1. A system for discouraging the unauthorized removal of an electronic device from a designated area, the system comprising:

an electronic device comprising:

at least one functional feature for performing at least one desired function;

an enabler, operatively coupled to the functional feature, for disabling the functional feature from performing the at least one desired function and for enabling the functional feature to perform the at least one desired function, the enabler initially disabling the functional feature; and a security device comprising a generator for generating a signal to the device-to permanently prevent the enabler from any further disabling of the functional feature and to thereafter permit the functional feature to perform the at least one desired function;

wherein the enabler is configured so as to no longer be able to disable the functional feature once the security device generates the signal and the signal is received by the enabler;

whereby the enabler cannot cause the functional feature to go from an enabled state to a disabled state once the security device generates the signal and the signal is received by the enabler.

2. The system as claimed in claim 1, wherein the enabler comprises a breakable link, operatively coupled to the functional feature, for initially disabling the functional feature from functioning; and wherein the security device generates an electromagnetic field that causes the breaking of the link thereby enabling the functional feature to function.

3. The system as claimed in claim 2, wherein the link is operatively coupled across the functional feature so as to initially disable functioning thereof; and when the electronic device is placed in proximity to the electromagnetic field, the link is broken and the functional feature is enabled.

4. The system as claimed in claim 3, wherein the link is comprised of a fuse, and wherein the link provides a short across the functional feature;

wherein when the electronic device is placed in proximity to the electromagnetic field, the short across the functional feature is removed.

5. The system as claimed in claim 1, wherein the electronic device is a timepiece.

6. The system as claimed in claim 5, wherein the timepiece is a watch.

7. The system as claimed in claim 1, wherein the functional feature is a display and wherein the at least one desired function is the display of indicia thereon, and wherein the electronic device cannot display the indicia on the display until the electronic device is placed in proximity to the electromagnetic field and receives the signal from the security device thereby causing the enabler to enable the functional feature.

8. A system for discouraging the unauthorized removal of an electronic device from a designated area, the system comprising:

an electronic device comprising:

at least one functional feature for performing at least one desired function;

a controller, operatively coupled to the functional feature, for controlling the operability of the functional feature;

an enabler, operatively coupled to the controller, for disabling the controller from controlling the operability of the functional feature and for enabling the controller to control the operability of the functional feature; and a security device comprising a generator for generating a signal to the device to permanently prevent the enabler from any further disabling of the controller and to permit the controller to control the operability of the functional feature;

wherein the enabler is configured so as to no longer be able to disable the controller once the security device generates the signal and the signal is received by the enabler;

whereby the enabler cannot cause the controller to go from an enabled state to a disabled state once the security device generates the signal and the signal is received by the enabler.

9. The system as claimed in claim 8, wherein the controller is operable in a plurality of modes, and wherein the enabler operatively prevents the controller from operating in at least one of the plurality of modes.

10. The system as claimed in claim 9, wherein the controller includes a subcontroller for operatively causing the at least one functional feature to perform the at least one desired function.

11. The system as claimed in claim 9, wherein the controller can cause the electronic device to enter a demonstration mode and an operational mode, and wherein the electronic device cannot (a) exit the demonstration mode nor (b) enter the operational mode until the security device transmits the signal to the device.

12. The system as claimed in claim 8, wherein the controller cannot operatively cause the functional feature to operate until the enabler enables the controller.

13. The system as claimed in claim 8, wherein the enabler comprises a breakable link, operatively coupled to the controller, for initially disabling the controller; and wherein the security device generates an electromagnetic field that causes the link to break thereby enabling the controller.

14. The system as claimed in claim 13, wherein the link is operatively coupled across the controller so as to initially disable operation thereof; and when the electronic device is placed in proximity to the electromagnetic field, the link is broken and the controller is enabled.

15. The system as claimed in claim 14, wherein the link is comprised of a fuse, wherein when the electronic device is placed in proximity to the electromagnetic field, the fuse is broken.

16. The system as claimed in claim 8, wherein the enabler is a smart receiver, the smart receiver for receiving the signal generated by the security device.

17. The system as claimed in claims 16, wherein the smart receiver includes a transmitter for transmitting information to the security device.

18. The system as claimed in claim 17, wherein the security device includes a receiver for receiving information transmitted from the electronic device;

wherein the smart receiver and the security device are able to communicate in a bi-directional manner, such that first signals containing information may be transmitted from the security device to the electronic device and second signals containing information may be transmitted from the electronic device to the security device.

19. The system as claimed in claim 8, wherein the enabler is a smart receiver, the smart receiver for receiving the electromagnetic field generated by the security device.

20. The system as claimed in claim 8, wherein the functional feature is a display operatively coupled to the controller, and wherein the at least one desired function is the display of indicia thereon, and wherein the electronic device cannot display the indicia on the display until the electronic device is placed in proximity to the electromagnetic field and receives the signal from the security device thereby causing the enabler to enable the controller.

21. The system as claimed in claim 8, wherein the electronic device is a timepiece.

22. The system as claimed in claim 21, wherein the timepiece is a watch.

23. A method of discouraging the unauthorized removal of an electronic device from a designated area, wherein the electronic device comprises at least one functional feature for performing at least one desired function and an enabler operatively coupled to the functional feature, for disabling the functional feature from performing the at least one desired function and for enabling the functional feature to perform the at least one desired function, the enabler initially disabling the functional feature, wherein the method comprises the steps of:

providing a security device in the designated area;

requiring that the electronic device be placed proximate the security device in order for the functional feature to be enabled;

generating a signal radiating outward from the security device to the electronic device;

causing the enabler to enable the functional feature, and thus enabling the functional feature to perform the at least one desired function;

permanently preventing the enabler from any further disabling of the functional feature;

wherein the enabler is configured so as to no longer be able to disable the functional feature once the security device generates the signal and the signal is received by the enabler;

whereby the enabler cannot cause the functional feature to go from an enabled state to a disabled state once the security device generates the signal and the signal is received by the enabler.

24. The method as claimed in claim 23, wherein the enabler comprises a breakable link operatively coupled to the functional feature, the method comprising the further steps of:

generating a electromagnetic field; and placing the electronic device in proximity to the electromagnetic field;

causing the breaking of the link; and enabling the functional feature.

25. The method as claimed in claim 23, including the step of:

providing the enabler within a timepiece.

26. A method of discouraging the unauthorized removal of an electronic device from a designated area, wherein the electronic device comprises at least one functional feature for performing at least one desired function, a controller operatively coupled to the functional feature for controlling the operability of the functional feature, and an enabler operatively coupled to the controller for disabling the controller from controlling the operability of the functional feature and for enabling the controller to control the operability of the functional feature, wherein the method comprises the steps of:

providing a security device in the designated area;

requiring that the electronic device be placed proximate the security device in order for the controller to be enabled;

generating a signal radiating outward from the security device to the electronic device;

causing the enabler to enable the controller and thus enabling the controller to control the operability of the functional feature;

preventing the enabler from any further disabling of the controller;

wherein the enabler is configured so as to no longer be able to disable the controller once the security device generates the signal and the signal is received by the enabler;

whereby the enabler cannot cause the controller to go from an enabled state to a disabled state once the security device generates the signal and the signal is received by the enabler.

27. The method as claimed in claim 26, including the steps of:

providing a controller operable in a plurality of modes; and operatively preventing the controller from operating in at least one of the plurality of modes.

28. The method as claimed in claim 27, wherein the controller can operate in a demonstration mode and an operational mode, including the steps of:

preventing the electronic device from exiting the demonstration mode;

causing the electronic device to receive the signal from the security device; and causing the electronic device to enter the operational mode.

29. The method as claimed in claim 26, wherein the enabler comprises a breakable link operatively coupled to the controller, the method comprising the further steps of:

generating a electromagnetic field; and placing the electronic device in proximity to the electromagnetic field;

causing the breaking of the link; and enabling the controller.

30. The method as claimed in claim 26, wherein the enabler is a smart receiver, the method comprising the steps of:

generating a electromagnetic field; and placing the electronic device in proximity to the electromagnetic field;

causing the smart receiver to communicate with the controller; and enabling the controller.

31. The method as claimed in claim 30, the method comprising the steps of:

causing the electronic device to transmit information to the security device;

causing the security device to transmit information to the electronic device;

whereby the smart receiver and the security device are able to communicate in a bi-directional manner, such that first signals containing information may be transmitted from the security device to the electronic device and second signals containing information may be transmitted from the electronic device to the security device.

32. The method as claimed in claim 26, including the step of providing the enabler within a timepiece.

33. An enabler for use in an electronic device that is part of a system for discouraging the unauthorized removal of the electronic device from a designated area, wherein the electronic device comprises at least one functional feature for performing at least one desired function, and the enabler, being operatively coupled to the functional feature, comprising:

a disabling arrangement that prevents the functional feature from performing the at least one desired function and that permits, once the disabling arrangement is disabled, the functional feature to perform the at least one desired function;

wherein the enabler initially disables the functional feature and thereafter enables the functional feature to perform the at least one desired function upon the receipt of a signal generated by a security device and further wherein the enabler is configured so that it is permanently prevented from any further disabling of the functional feature once the security device generates the signal and the signal is received by the enabler.

34. The enabler as claimed in claim 33, wherein the disabling means comprises a breakable link, operatively coupled to the functional feature, for initially disabling the functional feature from functioning; and wherein the enabling means is the breakability of the link.

35. The enabler as claimed in claim 33, wherein the link is comprised of a fuse, and wherein the link provides a short across the functional feature;

wherein when the electronic device is placed in proximity to an electromagnetic field generated by the security device, the short across the functional feature is removed.

36. An enabler for use in an electronic device that is part of a system for discouraging the unauthorized removal of an electronic device from a designated area, wherein the electronic device comprises at least one functional feature for performing at least one desired function, a controller operatively coupled to the functional feature for controlling the operability of the functional feature; and the enabler, being operatively coupled to the controller, comprising:

an arrangement that prevents the operability of the functional feature and that permits, once the arrangement is disabled, the controller to control the operability of the functional feature; and wherein the enabler initially disables the controller from controlling the operability of the functional feature and thereafter enables the controller to control the operability of the functional feature and further wherein the enabler is configured so that it is permanently prevented from any further disabling of the controller once the security device generates the signal and the signal is received by the enabler.

37. The enabler as claimed in claim 36, wherein the means comprises a smart receiver.

38. A security device for use in a system for discouraging the unauthorized removal of the electronic device from a designated area, wherein the electronic device comprises at least one functional feature for performing at least one desired function, an enabler operatively coupled to the functional feature for causing the disabling of the functional feature from performing the at least one desired function and for enabling the functional feature to perform the at least one desired function wherein the enabler is configured so as to no longer be able to disable the functional feature once the security device generates the signal and the signal is received by the enabler, the security device comprising:

a generator for generating an electromagnetic field for causing the enabler to be unable to further disable the functional feature and to thereafter permit the functional feature to perform the at least one desired function.

39. An electronic device for use in a system for discouraging the unauthorized removal of the electronic device from a designated area, the system having at least a security device comprising a generator for generating a signal to the device, the device comprising:

at least one functional feature for performing at least one desired function;

a controller, operatively coupled to the functional feature, and for controlling the operability of the functional feature; and an enabler, operatively coupled to the controller, for disabling the controller from controlling the operability of the functional feature and for enabling the controller to control the operability of the functional feature, wherein the enabler is configured so as to no longer be able to disable the controller once the security device generates the signal and the signal is received by the enabler;

wherein upon the generation of the signal by the security device and the causing of the electronic device to be placed in close proximity to the security device, the enabler enables the controller to control the operability of the functional feature and the enabler is no longer able to disable the controller.

40. The electronic device as claimed in claim 39, wherein the enabler comprises a breakable link, and wherein the signal generated by the security device is an electromagnetic field that causes the breaking of the link thereby enabling the functional feature to function.

* * * * *